United States Patent [19]

Focke et al.

[11] 4,303,155

[45] Dec. 1, 1981

[54] CUBOID CIGARETTE OR CIGAR PACK

[75] Inventors: Heinz Focke; Kurt Liedtke, both of Verden, Fed. Rep. of Germany

[73] Assignee: Focke & Co., Verden, Fed. Rep. of Germany

[21] Appl. No.: 54,070

[22] Filed: Jul. 2, 1979

[30] Foreign Application Priority Data

Jul. 29, 1978 [DE] Fed. Rep. of Germany ..... 2833389

[51] Int. Cl.[3] ..... B65D 85/10

[52] U.S. Cl. ..... 206/264; 206/273; 206/621

[58] Field of Search ..... 206/261, 264, 268, 271, 206/273, 274, 275, 621–626, 245; 229/44 CB

[56] References Cited

U.S. PATENT DOCUMENTS

| | | | |
|---|---|---|---|
| 2,557,914 | 6/1951 | Miller | 206/626 |
| 2,828,060 | 3/1958 | Brown | 206/624 |
| 3,093,292 | 6/1963 | Ahlobor | 206/264 |
| 3,680,767 | 8/1972 | De Lorenzo et al. | 206/621 |
| 3,893,614 | 7/1975 | Meyers | 206/626 |
| 3,948,389 | 4/1976 | Molin et al. | 229/44 CB |
| 3,999,655 | 12/1976 | Molins et al. | 206/264 |

*Primary Examiner*—Joseph Man-Fu Moy

*Attorney, Agent, or Firm*—Sughrue, Mion, Zinn, Macpeak and Seas

[57] ABSTRACT

An inner laminated foil wrapper 38 of a flip-top cigarette pack has fully sealed flap folds and seams to retain the moisture and aroma of the cigarettes. An opening flap 49 defined by a tear line 52 on the adjoining top and upper front surfaces of the wrapper has a finger tab 47 on its lower edge, overlying the cut-out front wall 35 of an upstanding collar 32, to facilitate opening the pack when the lid 21 is hinged back. The finger tab is formed by an adhesively sealed overlap of the wrapper foil.

4 Claims, 19 Drawing Figures

Figure 1:
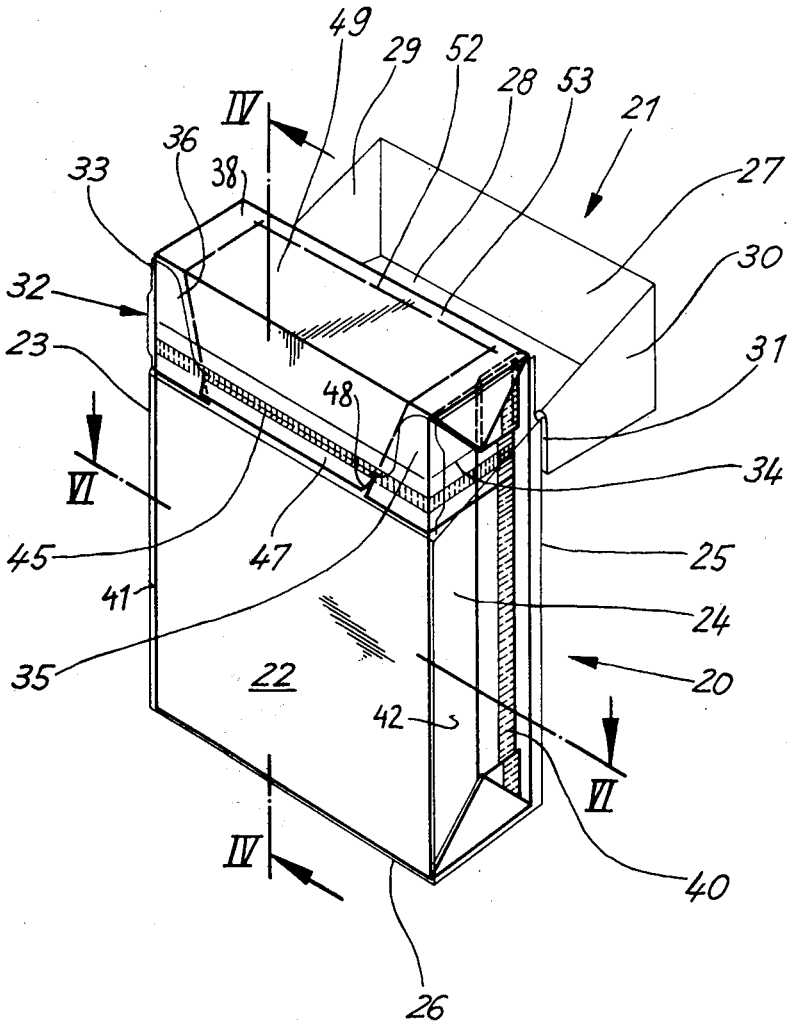

Fig. 13
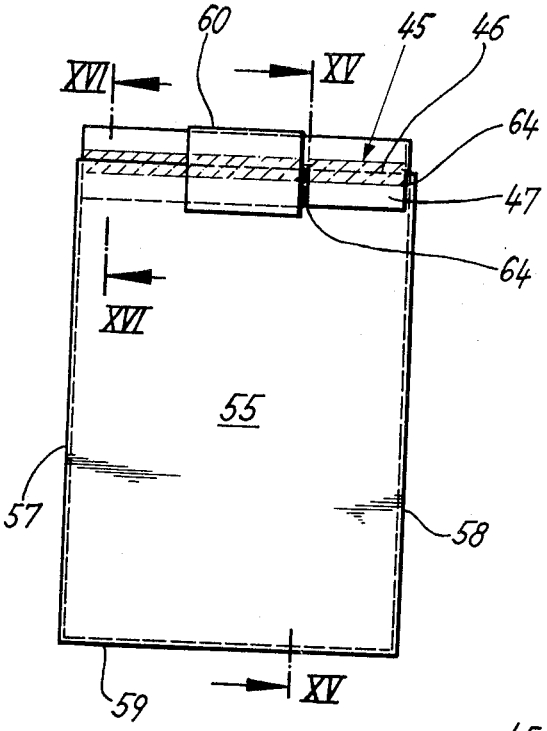
Fig. 15
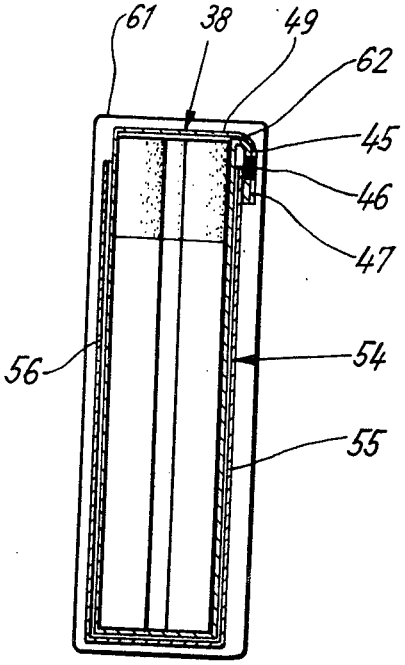
Fig. 14
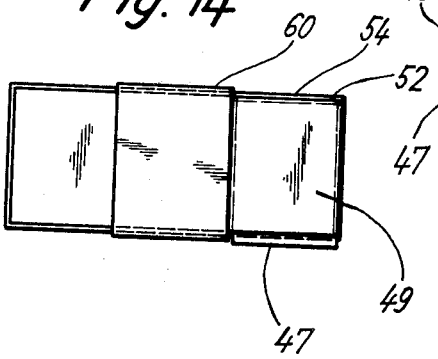
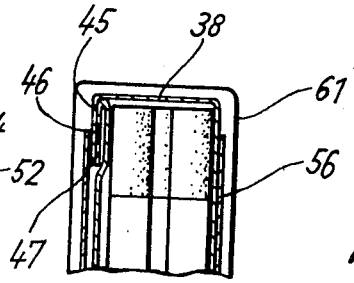
Fig. 16

CUBOID CIGARETTE OR CIGAR PACK

The invention relates to a pack, more particularly a cuboid pack, for cigarettes, small cigars or the like, with a wrapping which receives the pack contents and consists of a thin packaging material (tinfoil, laminated foil and the like) and preferably an outer wrap (hinge-lid box, pot or the like), the wrapping being provided with a tear-open device for opening it.

In designing cigarette packs, the impermeability of the packs is a particularly important subject, because the preservation of the quality of the cigarettes over what can under certain circumstances be a lengthy period before the cigarettes are consumed depends thereon.

Currently, it is predominantly two different embodiments of cigarette packs which are encountered on the market, namely hinge-lid boxes or hinge-lid packs on the one hand, and soft cup packs on the other hand. Both embodiments have a basic construction in common inasmuch as the cigarettes are accommodated in an inner wrapping of tinfoil. This is placed in the actual (hinge-lid box or soft cup) pack. Finally, a regenerated cellulose film wrapping is provided as the outer wrap. In spite of this three-part construction, the preserving effect of this conventional pack is, however, unsatisfactory.

In principle, packs have also already been disclosed which are made substantially air-tight and aroma-tight by heat-welding of the packaging material (laminate foils). These packs however in part deviate from the conventional, generally accepted constructions of cigarette packs. Furthermore, with these packs, opening the packs in order to use the pack contents presents problems.

Starting from this, it is the object of the invention to provide a substantially impermeable pack for cigarettes and the like, which pack is based on the construction of the previously known, commercially used cigarette packs, can be produced by machine without any problems and is easy to handle in use, especially on opening.

To achieve this object, the pack according to the invention comprises, in the region of one side of the pack, especially in the region of a front face of the wrapping (inner wrapping) a freely projecting tear-open tab which is formed by material overlap of the wrapping (inner wrapping).

The pack according to the invention—preferably for cigarettes—is distinguished by a virtually impermeable wrapping which preferably serves as the inner wrapping of a pack which in other respects is of conventional design, for example of the hinge-lid or soft cup type, that is to say it serves instead of the conventional, non-impermeable tinfoil wrap. A special feature of the invention is the provision of a tear-open mechanism in the region of the front face or end face of the wrapping, in that there a freely grippable tear-open tab, with attached pull-off strip, is formed from the wrapping blank, by material overlap. Preferably, this tear-open tab forms a part, namely a section, of a transverse seal (tube seam) of the wrapping. According to a further proposal of the invention, this relative position of the tear-open tab is selected so that the tab is held in a ready-to-grip position by a part of the further, outer pack. In a pack of the hinge-lid type the tear-open tab can rest on the middle region of a collar which is customary with this type of pack, so that in the closed position of the pack the tear-open tab is covered by the lid of the pack, but is freely grippable when the pack is open.

The tube seam or seal, which according to the invention acts as a tear-open tab, at least in a part-region, can at the same time also be formed in accordance with the peel-seal effect which is in itself known. Furthermore, in the case of multi-layer inner wrappings which include layers of plastic it is advantageous to mark the pull-off strip, within the inner wrapping blank, by lines of lesser cross-section.

Figure 2:
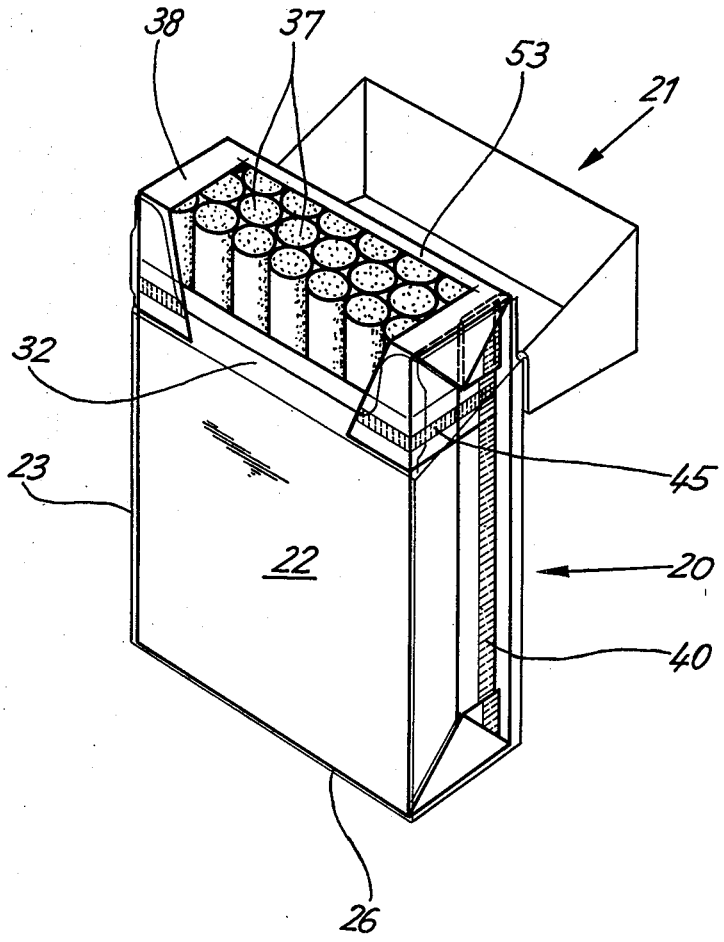
Figure 3:
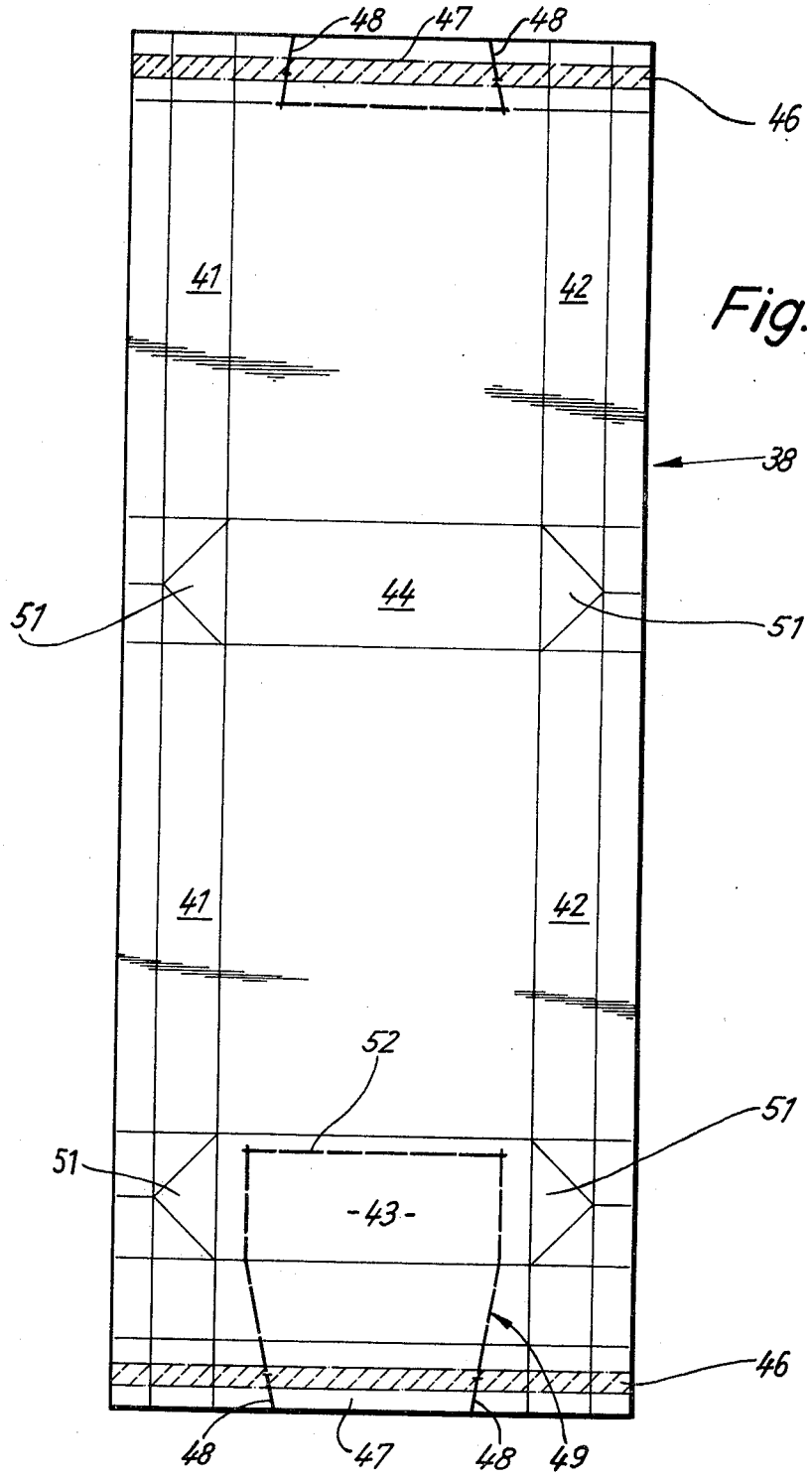
Figure 4:
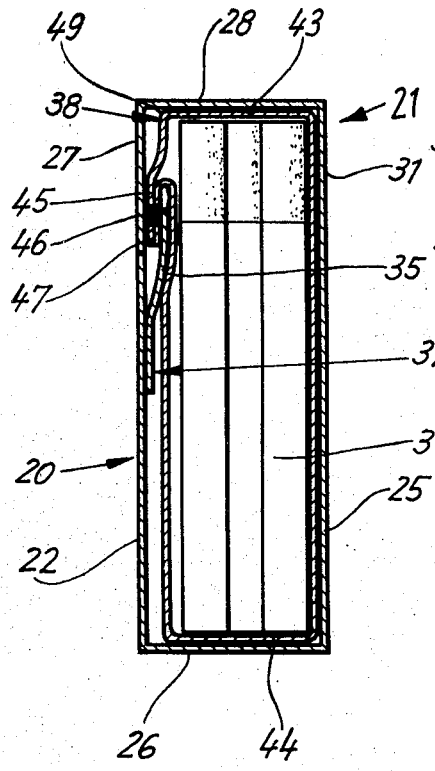
Figure 5:
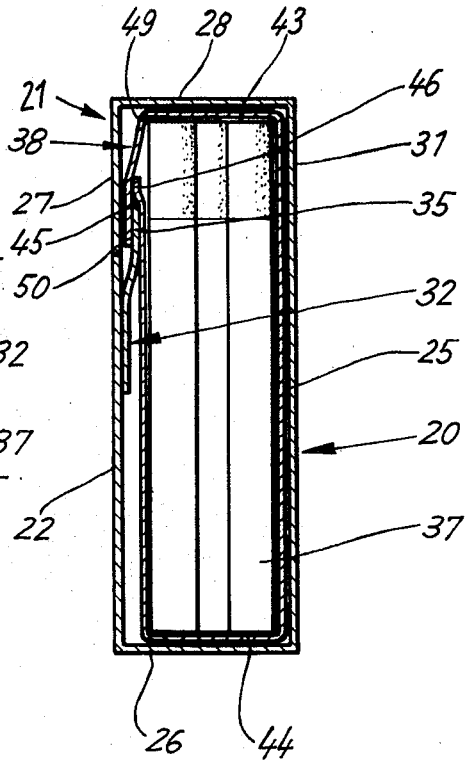
Figure 6:
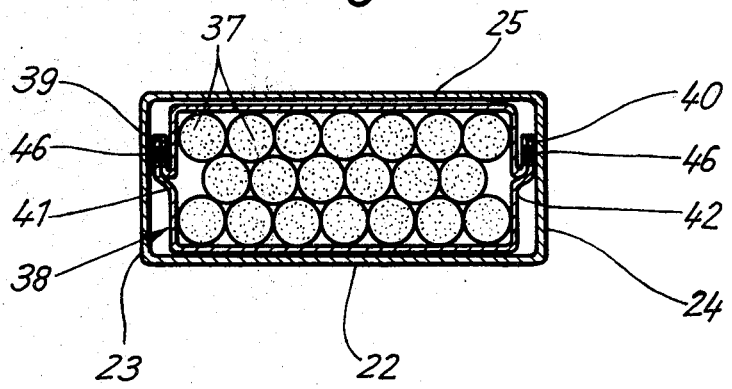
Figure 7:
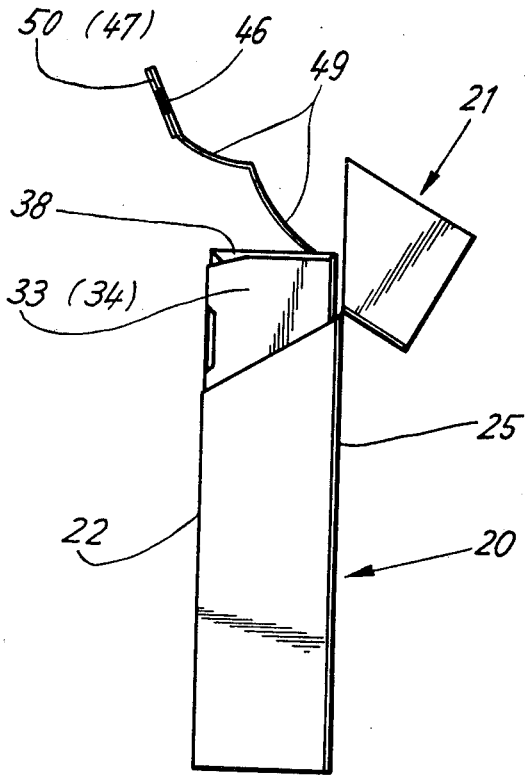
Figure 8:
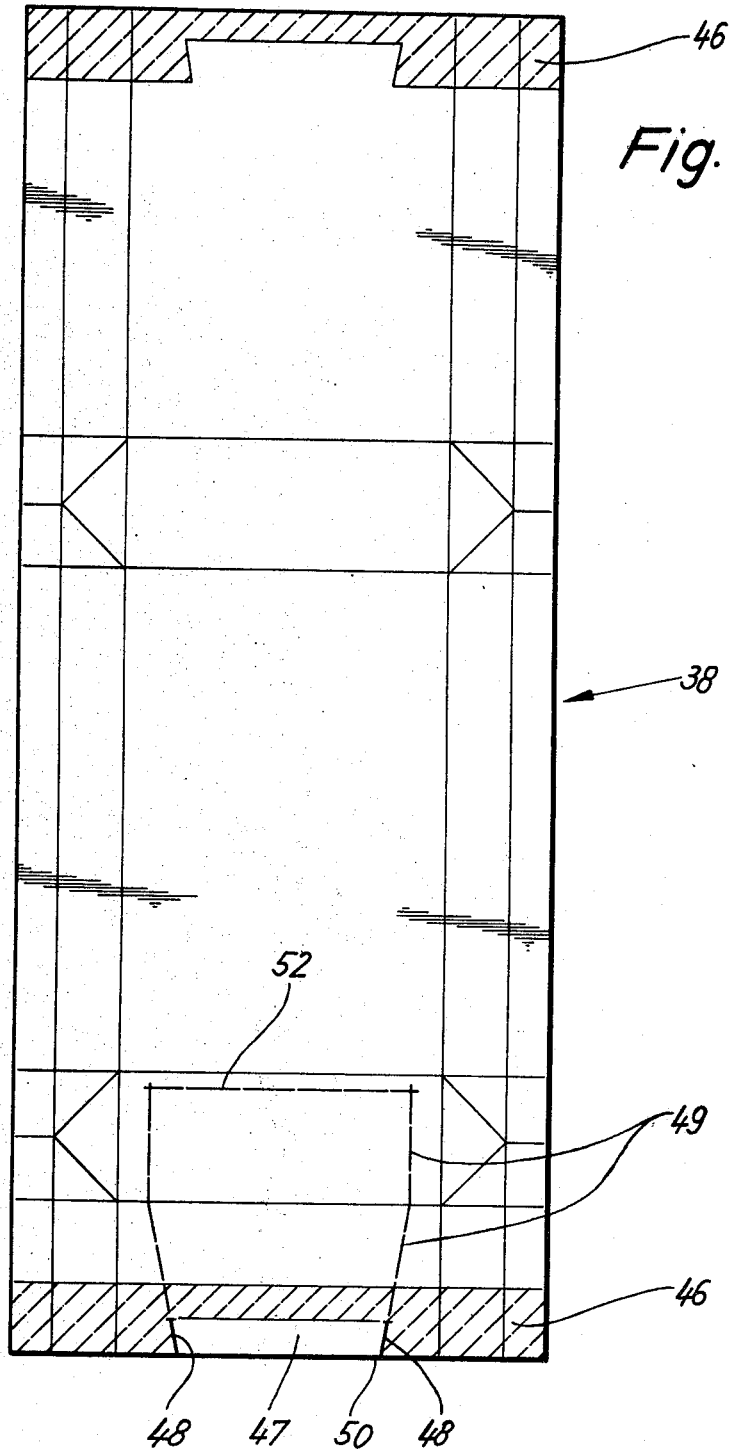
Figure 9:
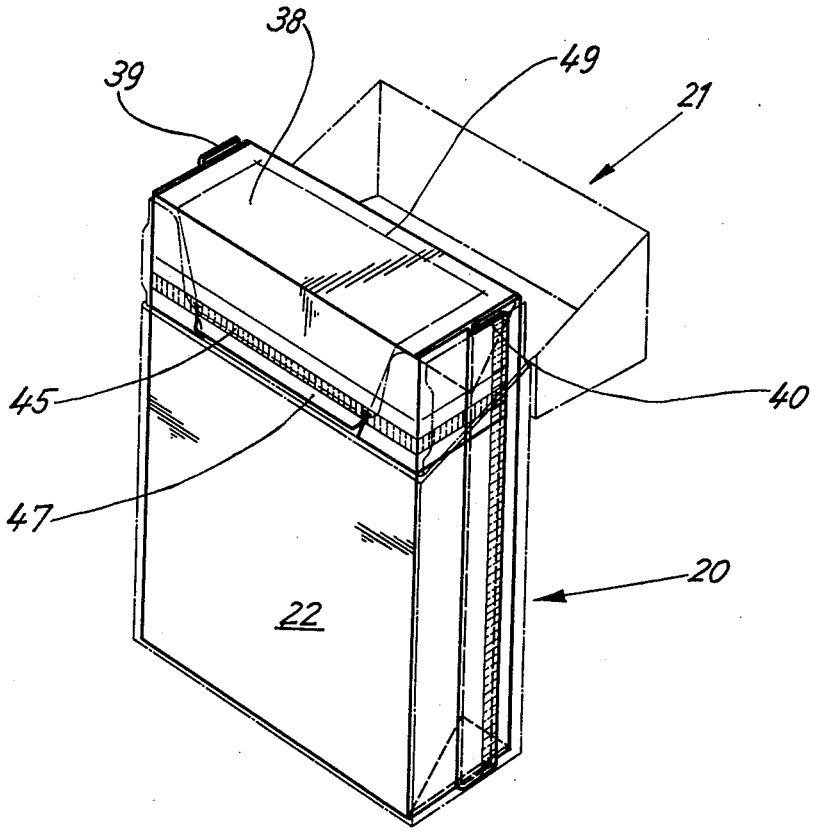
Figure 10:
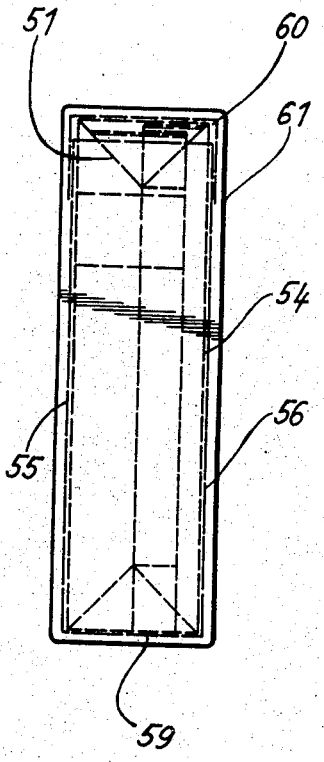
Figure 11:
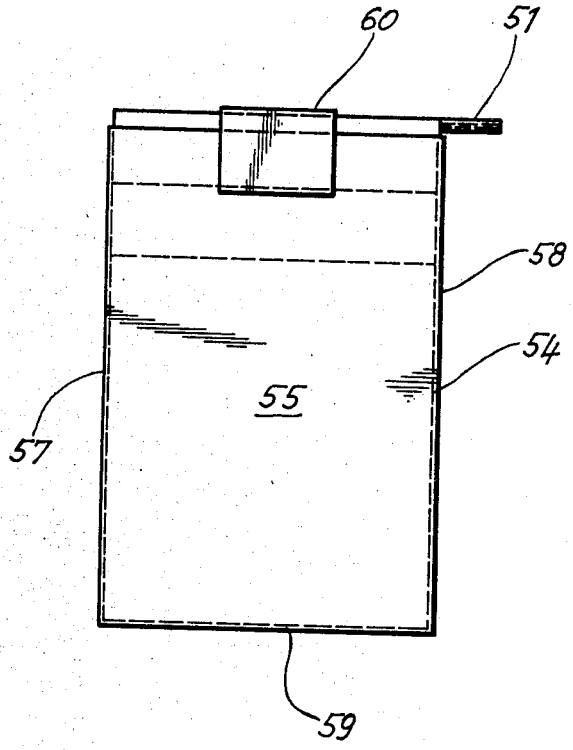
Figure 12:
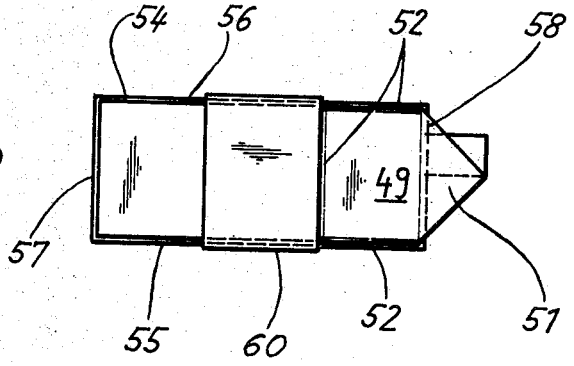
Figure 17:
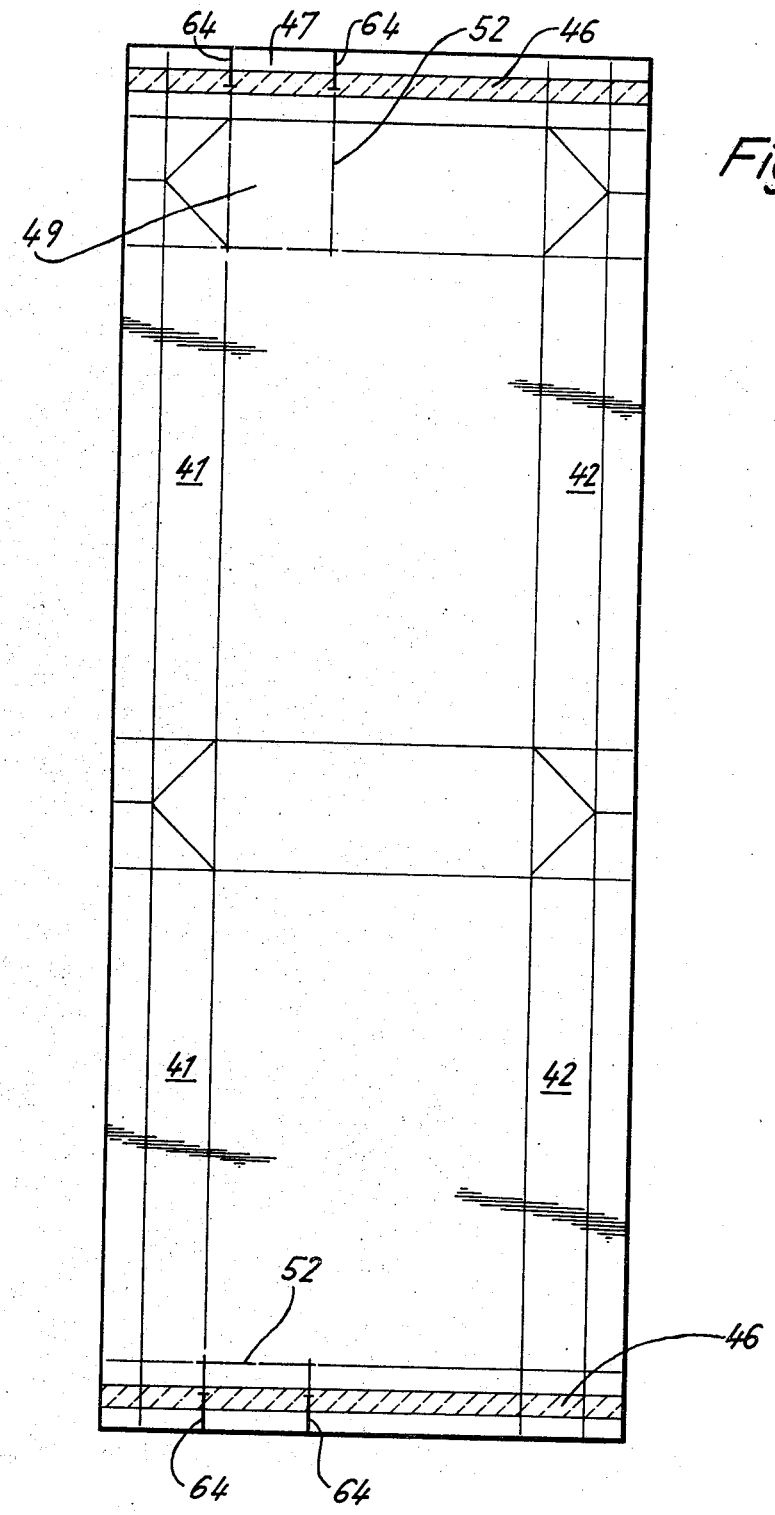
Figure 18:
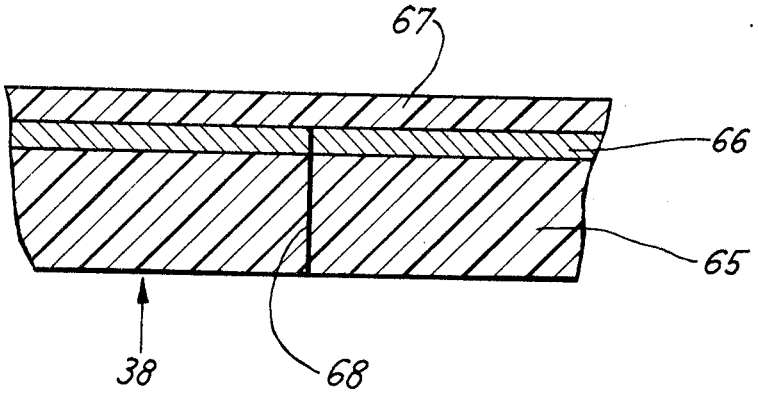
Figure 19:
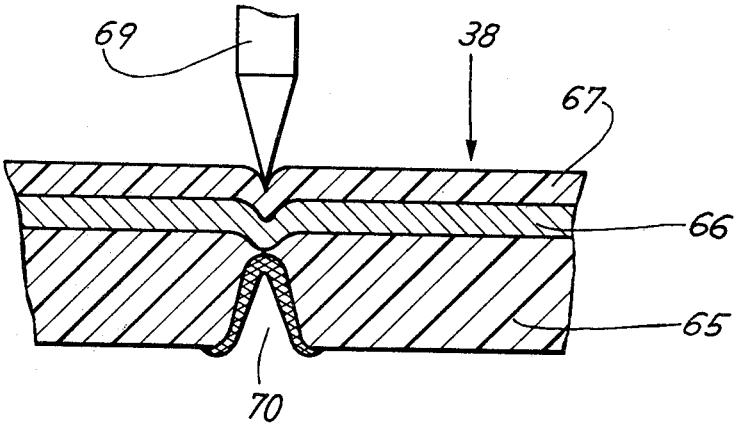

Illustrative embodiments of the invention are explained in more detail below with the aid of the drawings. In these:

FIG. 1 shows a hinge-lid box in perspective view, with the hinge-lid open,

FIG. 2 shows the pack according to FIG. 1 with the pull-off strip of an inner wrapping opened, again in perspective view, FIG. 3 shows a blank for the inner wrapping of the pack according to FIGS. 1 and 2, in the laid-flat state, FIG. 4 shows a vertical section through the pack according to FIG. 1, with the hinge-lid closed, FIG. 5 shows a vertical section according to FIG. 4 of another embodiment of the pack, FIG. 6 shows a horizontal section through the pack according to FIG. 1, FIG. 7 shows the pack according to FIG. 1 in side view, with the pull-off strip partially pulled off or opened, FIG. 8 shows a blank for the pack in the embodiment according to FIG. 5, in the laid-flat state, FIG. 9 shows a further illustrative embodiment of a pack in a representation corresponding to FIG. 1, FIG. 10 shows a soft cup pack as a further illustrative embodiment, in side view, with an outer wrap of regenerated cellulose film, FIG. 11 shows the pack according to FIG. 10 in front view, when put into use, FIG. 12 shows a plan view corresponding to FIG. 11, FIG. 13 shows an alternative embodiment of a soft cup pack in front view, FIG. 14 shows the pack according to FIG. 13 in plan view, FIG. 15 shows a vertical section XV—XV in FIG. 13, FIG. 16 shows a vertical section in the upper region of the pack according to FIG. 13, in the plane XVI—XVI, FIG. 17 shows a blank for an inner wrapping for the pack according to FIGS. 13 to 16, in the laid-flat state, FIG. 18 shows a cross-section through an inner wrapping, on a greatly enlarged scale and FIG. 19 shows a different embodiment of the inner wrapping, presented analogously to FIG. 18.

The examples of a cuboid cigarette pack shown in the drawings correspond in the basic construction to packs of the hinge-lid box or soft cup type.

FIG. 1 shows a hinge-lid box with a box portion 20 and a lid 21 hingedly connected thereto. The box portion 20 usually consists of the front wall 22, side walls 23, 24, a rear wall 25 and a bottom 26. The lid 21 comprises a lid front wall 27, lid end wall 28, lid side walls 29 and 30 and lid rear wall 31 hingedly connected to the rear wall 25 of the box portion.

In the box portion 20 there is provided a collar 32—consisting, for example of a separate blank—which partially projects from the box portion 20 and, where it does so, forms collar side walls 33, 34 and a collar front wall 35. The latter is provided with a cut-away portion 36, customary in such packs. With the pack closed, the part of the collar 32 which projects from the box portion 20 is enclosed by the lid 21.

In the pack thus formed, the contents, namely a group of cigarettes 37, are accommodated within an inner wrapping 38. The latter consists of a substantially impermeable material, for example a tinfoil, or a laminated foil the details of which will be discussed later.

The inner wrapping 38 is of a particular construction. A previously formed tubing surrounds the cigarettes 37 in such a way that the latter are arranged transversely to the direction of the tubing. Seals 39 and 40, which also run transversely to the direction of the tubing, as a result extend in the direction of the cigarettes 37. They are formed in the region of the side walls 23, 24 of the pack or in the region of the corresponding side faces 41, 42 of the inner wrapping 38. The end face 43 and bottom face 44 of the inner wrapping 38 hence remain free from folds.

The tubing, which is the intermediate product for forming the inner wrapping 38, is produced by forming a tube seam 45 which runs transversely to the cigarettes 37.

The impermeable inner wrapping 38 constructed as described above is inserted into the pack, namely the box portion 20, in such a way that the seals 39, 40 which rest tightly against the side faces 41, 42 are located between these side faces 41, 42 and the side walls 23, 24. In the present illustrative embodiments, the seals 39, 40 are constructed as a fin-like fold. This means that initially projecting tabs are bonded to one another by a seal, for example a weld 46, with the inner faces of the foil against one another, and the sealing strip thereby formed is folded over.

The tube seam 45 can, in the sense of the illustrative embodiment according to FIG. 4, also be a fin construction and be folded over flat against the inner wrapping 38, advantageously in such a way that the sealing strip formed faces downwards.

The tube seam 45 (or some other seam located in this region) fulfils a particular function on opening the inner wrapping 38. The tube seam 45, or the sealing strip formed therefrom, acts as a tear-open tab 47. For this purpose, the tube seam 45 or a middle region thereof, serving as the tear-open tab 47, is located within the cut-away portion 36 of the collar 32, that is to say at the front face of the pack. The relative arrangement is so chosen that the folded-over sealing strip of the tube seam 45, or the tear-open tab 47, rests, in the starting position, against the outside of the collar front wall 35 or on the edge thereof. The tear-open tab 47 marked by short lateral incisions 48 can as a result be gripped very easily. With the pack closed, the tear-open tab 47 is located in the region between the lid front wall 27 and the collar front wall 35, invisible from the outside. By gripping and pulling the tear-open tab 47, a pull-off strip 49 is pulled off the remainder of the inner wrappings 38, thereby providing access to the cigarettes 37.

According to FIG. 5, the tube seam 45 can also be constructed in a different manner, namely using the peel-seal effect which is in itself known. Here, the inner and outer face of the foil rest against one another and are welded to one another in such a way that the tear-open tab 47, which lies on the outside, can, on opening the inner wrapping 38, be pulled off the layer of the inner wrapping 38 which is underneath it. In this illustrative embodiment, again, the tear-open tab 47 forms a lower free tab edge 50 which is arranged in the manner which has been described, and can be gripped.

The inner wrapping 38 can consist of a one-piece blank as shown in FIG. 3 and FIG. 8. The folds are premarked by appropriate folding lines. At the upper and lower face of the inner wrapping 38, the side folds produce substantially triangular corner pieces 51. In the embodiment according to FIG. 1, these corner pieces 51 point sideways in an intermediate folding position, and are thereafter bent over downwards against the side faces 41, 42 of the inner wrapping 38. In the pack, the corner pieces 51 are fixed in this position by the side walls 33, 34 of the collar.

In the alternative embodiment according to FIG. 9, the folding procedure is so chosen that the corner pieces 51 are folded inwards, that is to say they are here covered by the side faces 41, 42 of the inner wrapping.

The pull-off strip 49 which adjoins the tear-open tab 47 is premarked, in the present illustrative embodiments, by a tear line 52. This tear line 52, the details of which will be described later, is so arranged that the pull-off strip 49 extends on the front face of the pack, in the region of the cut-out portion 36 in the collar 32, and, adjoining thereto, over the greater portion of the end face 43 of the inner wrapping 38, so that a foil rim 53 is left at the side and on the rear face. Advantageously, the pull-off strip 49 is not removed completely but folded back into the starting position when closing the pack which has been opened.

An example of the construction of a soft cup pack is shown in FIGS. 10 and 12. The cup 54 consists, in the usual manner, of a front wall 55, rear wall 56, side walls 57 and 58 and bottom 59. The contents of the pack, namely the inner wrapping 38 containing cigarettes 37, project somewhat from the cup 54 which is open at the top. In the present illustrative embodiment, one of the upper corner pieces 51, located at the side, serves as a tear-open tab having a pull-off strip 49 adjoining it. This strip is marked out by tear lines 52 so that an opening can be formed up to a central, transversely located control mark 60 or the like.

The corner piece 51, in this case, rests, in the starting position, externally against the side wall 58 of the cup 54. This starting position can be ensured either by lightly sticking the corner piece 51 against the side wall 58 or by providing a further outer wrap in the form of a sealed regenerated cellulose film wrap 61. On opening the pack, an upper part of this outer wrap is usually severed, so that the corner piece 51 thereby automatically becomes free and can be gripped, to serve as a tear-open tab.

In the alternative solution according to FIGS. 13 to 17, the tube seam 45 again serves as the tear-open tab 47. The tube seam 45 is, in the illustrative embodiment shown here, constructed in the manner of FIG. 4, but can also be constructed analogously to FIG. 5. The tube seam 45 which extends over the entire width of the pack is here formed in the region of an upper front edge 62 of the pack or of the inner wrapping 38. The sealing strip formed by the tube seam 45 is folded over against the front face of the pack. In the present illustrative embodiment, the tube seam 45, or the sealing strip formed by it, is fixed in position by the cup 54. For this purpose, the folded-over tube seam 45 projects into the region between the front wall 55 of the cup 54 and the front face 63 of the inner wrapping 38.

A lateral region of the tube seam 45, namely alongside the transverse control mark 60, is constructed as a tear-open tab 47. The latter rests externally on the front wall 55 of the cup 54 and can as a result easily be gripped when the regenerated celluose film wrap 61 has been partially removed. The tear-open tab 47 is delimited from the adjoining region of the tube seam 45 by an incision 64. The pull-off strip 49 adjoining the tear-open tab 47 here extends over the entire width of the end face 43 of the inner wrapping 38.

On detaching the pull-off strip 49 from the inner wrapping 38, the material of the inner wrapping 38 must be severed in the tear-open direction, but also transversely thereto, namely at the beginning of the tearing process. For this purpose, special measures must be taken and the foil used for the inner wrapping 38 must be of appropriate construction. According to FIGS. 18 and 19, the inner wrapping 38 consists of a three-layer laminated foil with an inner layer 65 of relatively low melting point, for example an inner layer of polyethylene. This is followed by an intermediate layer 66 of an aluminum which ensures the impermeability. This layer is covered by an outer layer 67 which has a higher melting point and consists, for example, of polyester. The melting point of the inner layer 65 is about 100 degrees centigrade, whilst the melting point of the outer layer 67 is of the order of magnitude of 250 degrees centigrade. Appropriate thicknesses of the layers are about $12\mu$ for the intermediate layer 66 and outer layer 67, whilst the inner layer 65 can be of greater thickness, for example $15\mu$.

To form the tear lines 52, the inner layer 65 and the intermediate layer 66 are, in the case of the illustrative embodiment of FIG. 18, severed by an incision 68. Accordingly, during the tearing process it is only the continuous outer layer 67 which remains to be destroyed.

FIG. 19 shows a particular example of how the tear line 52 can be produced. A sharp-edges, heated tool 69 is applied to the side of the outer layer 67. The temperature of this tool is such that sufficient heat can penetrate through the outer layer 67 and the intermediate layer 66 and that the inner layer 65 is caused to melt locally, forming a notch 70. The notch 70 forms an efficient tear line. The tearing process is assisted by the fact that the material forms a crust on either side of the notch 70.

We claim:

1. A flip-top cigarette pack, comprising:

(a) a rectangularly shaped outer container (20) formed from a blank of relatively stiff paper, cardboard or the like, and having an openable and closeable lid top (21) hingedly connected to an upper rear edge of the container, (b) a collar (32) extending upwardly from the opposite sides and front face of an upper open mouth of the container, the collar fitting within the lid top when closed, (c) a cut-out portion (36) defined in a front wall (35) of the collar, (d) a rectangularly shaped inner wrapper (38) folded from a blank of moisture and aroma proof material and configured to fit closely within the outer container, all seams and flaps of the wrapper being tightly joined to hermetically seal the wrapper, (e) an opening flap (49) disposed on adjoining top and upper front surfaces of the wrapper and defined by a tear line (52), and (f) a freely projecting finger grippable tab (47) provided on an edge of the flap and extending laterally across the wrapper proximate the cut-out portion in the front wall of the collar, (g) the tab being formed by an adhesively sealed overlap of the wrapper material, and being downwardly directed and overlying the front wall of the collar below the cut-out portion.

2. A cigarette pack according to claim 1, wherein the sealed overlap which forms the tab comprises a section of a tube seam (45) of the wrapper extending continuously across both sides and the front surface thereof.

3. A cigarette pack according to claim 1, wherein the wrapper material is a metal foil laminate comprising an inner layer of polyethylene, and the tear line is defined by a thermally formed groove therein.

4. A cigarette pack according to claim 3, wherein the metal foil laminate comprises an intermediate layer of metal foil and an outer layer of polyester.

* * * * *